United States Patent [19]

Paulikas

[11] Patent Number: 4,799,249

[45] Date of Patent: Jan. 17, 1989

[54] SELF-CLEANING ROTATING ANODE X-RAY SOURCE

[75] Inventor: Arvydas P. Paulikas, Downers Grove, Ill.

[73] Assignee: The United States of America as represented by the United States Department of Energy, Washington, D.C.

[21] Appl. No.: 56,825

[22] Filed: Jun. 2, 1987

[51] Int. Cl.[4] ..... H01J 35/10

[52] U.S. Cl. ..... 378/125; 378/121; 250/423 R

[58] Field of Search ..... 378/125, 204, 119, 121; 250/423 R

[56] References Cited

U.S. PATENT DOCUMENTS 3,334,228 8/1967 Mattson ..... 378/49

4,344,019 8/1982 Gavia et al. ..... 250/423 R

FOREIGN PATENT DOCUMENTS 0080742 4/1986 Japan ..... 378/125

*Primary Examiner*—Carolyn E. Fields
*Assistant Examiner*—David P. Porta
*Attorney, Agent, or Firm*—Frank J. Kozak; Michael J. Higgins; Judson R. Hightower

[57] ABSTRACT

A self-cleaning rotating anode x-ray source comprising an evacuable housing, a rotatable cylindrical anode within the housing, a source of electrons within the housing which electrons are caused to impinge upon the anode to produce x-rays, and means for ionizing residual particles within the housing and accelerating such ions so as to impinge upon the anode to sputter impurities from the surface thereof.

6 Claims, 2 Drawing Sheets

SELF-CLEANING ROTATING ANODE X-RAY SOURCE

CONTRACTUAL ORIGIN OF THE INVENTION

The U.S. Government has rights in this invention under Contract No. W-31-109-ENG-38 between the U.S. Department of Energy and the University of Chicago.

BACKGROUND OF THE INVENTION

This invention relates to a rotating anode x-ray source, commonly used in research to provide a continuous duty source of x-rays for studying the structure and composition of materials, and more particularly, this invention relates to a rotating anode x-ray source having a means to continuously remove impurities from the surface of the anode during operation.

In using x-rays to study materials, the differences in the absorption of different wavelength radiation by a specimen can provide valuable information about the structure of the material. In some x-ray absorption studies it is desirable to use a x-ray source having a continuous frequency band and constant amplitude, to monochromatize it, and to measure the absorption of discrete frequencies of x-rays by the material. In other studies of materials, it is desirable to provide discrete x-ray frequencies (a line spectrum) for measuring the diffraction by a specimen's crystal structure. In either case, the actual x-ray spectra emitted from a diode x-ray source will depend upon accelerating voltages between the anode and cathode and the constitutent materials of the anode including any impurities that may be transferred to the anode from the cathode.

In a rotating anode x-ray generator, electrons are ejected from a heated filament and are accelerated through a potential difference towards the anode, which they strike with high velocity. At an electron's point of impact upon the anode, x-rays are produced which radiate in many directions. Radiation produced by the electrons colliding with the anode will have a continuous frequency spectrum and superimposed on the spectrum will be a series of sharp intensity maxima at certain wavelengths. These maxima are known as characteristic lines and their wavelength and magnitude depend on the target material.

During normal use of the x-ray generator, some filament material is transferred to the anode from the filament, hence, characteristic lines will appear in the output radiation spectrum which are dependent upon the material used in the filament. For example, if the filament is made of tungsten, tungsten characteristic lines will appear in the output x-ray spectrum, which may not be desirable for the particular purpose of the instrument.

In applications as described above where the output x-ray spectrum should be free from undesirable frequencies, the deposition of impurities on the anode will degrade the quality of the output spectra emitted from the x-ray source.

In-situ methods of cleaning an x-ray anode have been used which utilize sputtering of the surface to remove impurities from the anode. For example, U.S. Pat. No. 3,334,228 issued to R. A. Mattson discloses an x-ray spectrometer having an x-ray source with a continuously cleaned x-ray target. The invention disclosed by Mattson utilized a rotating anode x-ray source with a source of ions propelled down a tube held in close proximity to the rotating anode. The ions propelled down the tube sputter impurities off the rotating anode, which impurities thereafter settle in the tube to be removed at a later time during a manual cleaning process.

The Mattson apparatus for continuously cleaning the rotating anode source uses a tube, contoured to conform to the circular periphery of the anode almost contiguous with the anode but with a small clearance gap. An ionized gas introduced into the tube sputters impurities from the anode surface. The gap between the tube and the rotating anode as disclosed in Mattson must be sufficiently small to sustain a difference in the magnitude of the vacuum between the interior of the tube and the exterior of the tube. The close fit required by Mattson is not easily attainable and increases the cost of such a continuously cleaned anode. The slow rotation (about one revolution per minute) of the anode which is specified by Mattson is not compatible with the high power (15 kilowatt) rapidly rotating (6000 revolutions per minute) anode x-ray generator which is in common use.

In addition, the sputtering gas introduced into the tube which is ionized to produce sputtering ions further "loads" the vacuum source required to maintain a low pressure within the tube. The higher pressure associated with the introduction of a gas may result in attenuation of the x-rays produced in the source and also prematurely ages the filament used therein.

Accordingly, an object of the invention is to provide a method of in-situ cleaning of an anode used in an x-ray source.

It is another object of the invention to present a rotating anode x-ray source wherein the x-ray source may be operated while being continuously cleaned without detrimental effect on the filament or other operational components.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combination particularly pointed out in the appended claims.

SUMMARY OF THE INVENTION

To achieve the foregoing objects of the present invention there is provided a rotating anode x-ray source comprising an evacuable enclosure, a rotatably mounted cylindrical anode within said enclosure, a source of electrons within said enclosure, an ion source means within said enclosure for ionizing residual atoms and molecules within said enclosure and accelerating said ions toward said anode. The accelerated ions impinge upon the anode, sputtering impurities off the surface to provide a continuous cleaning of the rotating anode which thereby improves the emitted spectrum.

DETAILED DESCRIPTION OF THE PREFERRED EMBODIMENT

Figure 1:
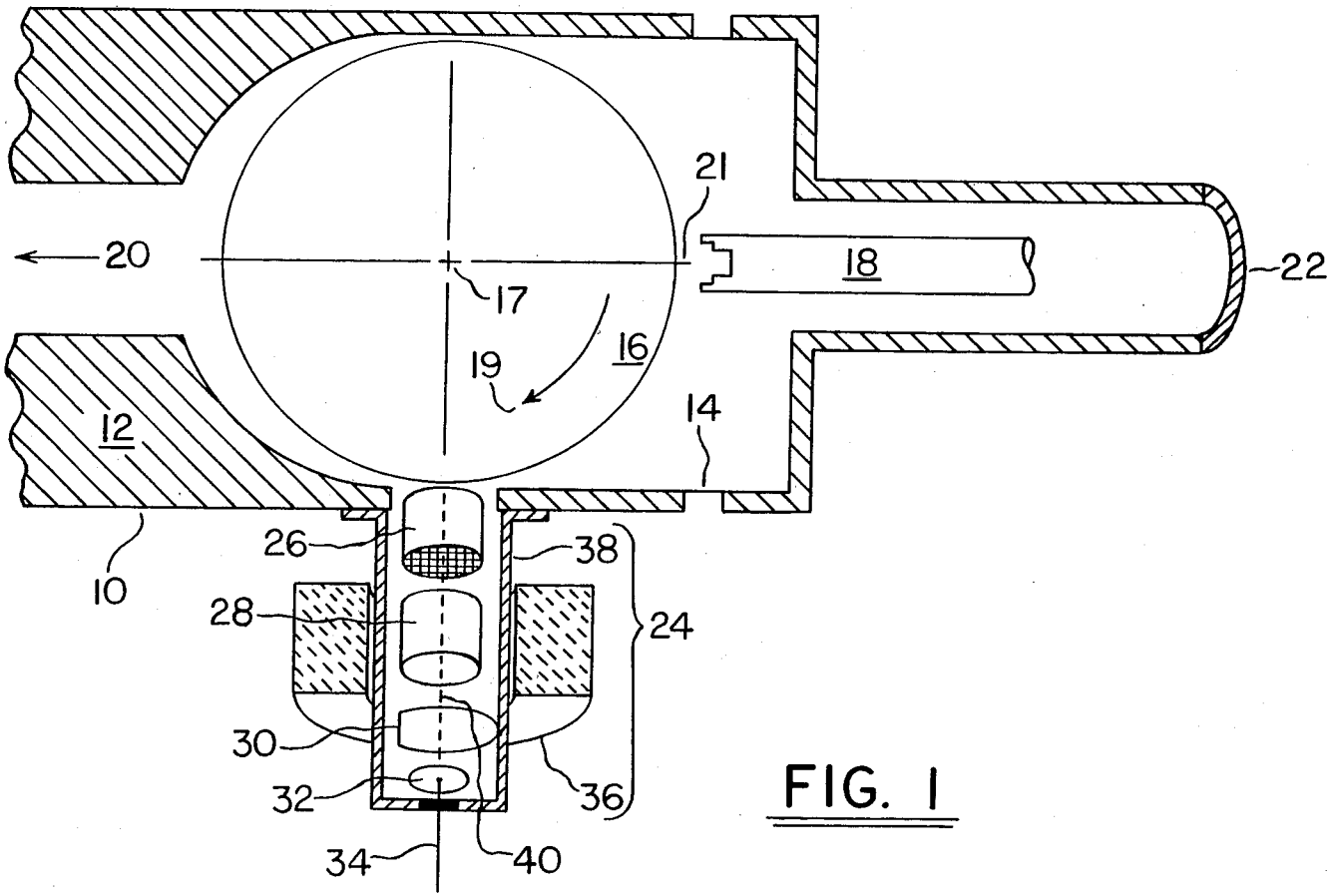
FIG. 1 discloses a schematic cross-sectional diagram of a preferred embodiment of the invention showing a rotating anode, an electron source and the relative positions of the ion source and its constituent elements.

Referring to FIG. 1, there is shown a representative cross-sectional diagram of a rotating anode x-ray source 10 with a continuously cleaned rotating anode 16. An evacuated metal housing 12 contains the rotating anode 16, an electron source 18, and an ion source 24. The ion source 24 is adapted to collect, ionize and accelerate residual particles that remain within the enclosure formed by housing 12. The ionized residual particles strike the anode 16 and impurities are sputtered from the anode surface and settle elsewhere in the housing 12.

The ion source used in the preferred embodiment is a modified Penning trap. A Penning trap is a device normally used as an ion pump, to assist in evacuating enclosed volumes in combination with mechanical vacuum pumps to achieve very high vacuum levels. However, in the instant invention, such Penning trap is not used to remove ions from the housing but rather is configured as an ion source that is comprised of a series of electrodes and a toroidal magnet, which captures free residual atoms and/or molecules, ionizes them and accelerates the ions toward the anode, to sputter impurities from the anode surface.

Referring to FIG. 1 in detail, the x-ray source 10 comprises an evacuated metal housing 12, the interior regions of which are pumped to a high vacuum by an external vacuum source (not shown) connected to the interior regions of housing 12 through a port 20. The preferred embodiment operates with a vacuum in the range of $10^{-5}$ Torr. A cylindrically shaped anode 16 is mounted within the evacuated region and rotates about a central axis 17 in the direction of arrow 19 as shown. A complete operative device includes means for rotating anode 16. Such means are well known in the art and form no part of the instant invention, thus, are not depicted.

A cathode assembly 18, is connected to an external voltage source through a high vacuum feed-through 22, in the side of the housing 12. The cathode assembly 18, which contains a hot tungsten filament, at a large negative voltage preferably on the order of −50,000 volts, provides a source of electrons which are attracted to the rotating anode 16 which is at ground potential. The accelerated electrons strike the anode and thereby produce x-rays.

X-rays produced by the impacting electrons are permitted to leave the housing 12 through an x-ray emission window 14 in the side of the housing 12.

In normal operation, small amounts of tungsten from the hot filament (not shown) i cathode 18 will be transferred to the rotating anode 16, which as discussed above, will emit their own characteristic lines in the x-ray spectra if tungsten builds up on the anode 16 surface.

After an area on the anode 16 rotates past the cathode 18 it rotates in front of the Penning trap 24 to be cleansed by the impinging positive ions produced in the Penning trap 24.

Positive ions produced by the Penning trap 24 travel along a central axis line 40 and impinge upon the rotating anode to sputter impurities from its surface.

Figure 2:
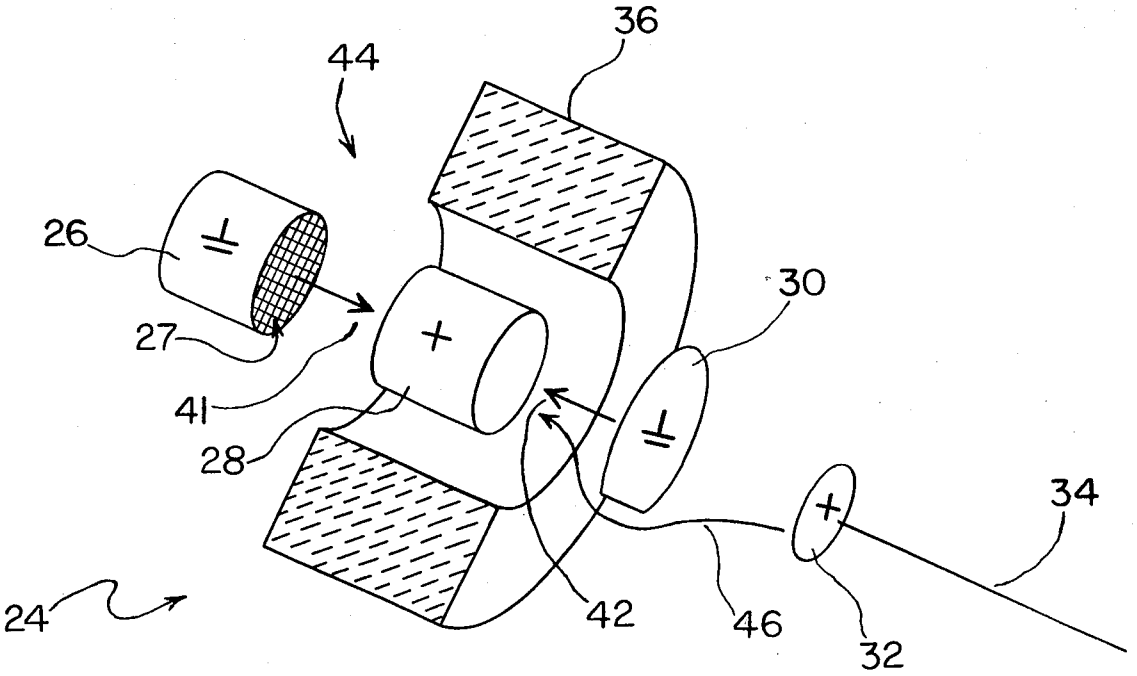
FIG. 2 shows an isometric view of a Penning trap that may be used to produce ions that cleanse the rotating anode.

Referring now to FIG. 2, there is shown an isometric view of the constituent elements of the Penning trap 24. Only one half of a toroidal magnet 36 is shown in FIG. 2 to permit more detailed description and viewing of the electrode elements positioned in its interior region.

The electrodes 26, 28, 30 and 32 in combination with the toroidal magnet 36 provide a means of ionizing residual atoms or molecules that drift into the region within housing 12 in the vicinity of Penning trap 24.

Still referring to FIG. 2, there is shown a first tubular electrode 26 at electrical ground with a wire grid 27 mounted on one end of the tube away from the anode 16. Displaced from electrode 26 is a second tubular electrode 28 carrying a high positive voltage, typically near 5000 volts in th preferred embodiment, electrode 28 being mounted coaxially with the toroidal magnet 36 as shown. Displaced from electrode 28 is third electrode 30 in the shape of a flat disk also at electrical ground and removed from the interior regions of toroidal magnet 36. A fourth electrode, further displaced from electrode 30, is another flat disk 32 at a high positive potential typically near 5000 volts in the preferred embodiment.

Electrode 26 being at electrical ground potential and electrode 28 being at a high positive potential, provide an electric field that acts to accelerate negative particles in the direction shown by arrow 41 toward electrode 28. Similarly, electrode 30, also at a electrical ground potential acts with electrode 28 to repel negative charged particles toward electrode 28. Since electrode 28 is in the center of magnet 36, coaxially mounted as shown, within the region bounded by magnet 36, magnetic flux lines associated with magnet 36 will be, near the axis of the device, generally coaxial with the electric fields produces by electrodes 26, 28 and 30 and represented by field lines designated by arrows 41 and 42. Electrode 32, at a high positive potential acts as a "mirror" to deflect positive ions, preventing a build-up of ions away from the anode.

As configured, electric fields provided by electrodes 26, 28 and 30 in combination with the magnetic field provided by magnet 36 provide a "bottle" for electrons such that the high positive potential on electrode 28 attracts the negatively charged particles to the region bounded by electrode 28. Magnetic lines of flux provided by the magnet 36 and aligned with the electric field lines will exert a radial force on electrons moving under the influence of these electric fields thereby effectively containing these negatively charged particles to the region bounded by the tubular electrode 28. The confined electrons serve to ionize an appropriate fraction of neutral residual gas atoms or molecules which diffuse into the Penning trap.

The positive ions being attracted to the grounded electrodes 26 and 30 acquire a linear velocity such that, in the case of electrode 26 they pour through grid 27 and proceed towards anode 16. By virtue of their heavier mass, the positive ions are not significantly deflected from their initial trajectories by the magnetic field, and they impinge upon the rotating anode 16 (not shown in FIG. 2).

As in any Penning trap, the spacing of electrodes 26, 28 and 30 with respect to each other and magnet 36 is not critical subject to two limiations: spacing between these respective electrodes must be sufficiently great to prevent electric arcing between each of these elements. Conversely, the spacing must be sufficeintly small such that the electric field lines 41 and 42 are substantially within the region bounded by magnet 36 and generally parallel to the magnetic flux lines associated with the magnet. Generally, increasing the voltage carried by electrode 28 and 32 and/or decreasing the voltage carried by electrode 26 and 30 will increase the electric field strength between these electrodes and facilitate the formation of ions but the voltage is limited by the threshold of arcing.

In the preferred embodiment, the magnetic field provided by magnet 36 is on the order of 2.5 to 5 kilogauss. Electrodes 26 and 30 are grounded. Electrodes 28 and 32 are at +5000 v.

It has been noted in using a Penning trap as an ion source that small quantities of electrode material are stripped off of the grounded electrodes as well. By proper selection of electrode materials, i.e. if the electrodes 26 and 30 are made of the same materials as the anode 16, some fraction of the materials stripped off of these electrodes will be deposited onto the anode 16 surface itself. By such selection of electrode materials, in addition to the ionization of residual atoms that sputter impurities from the anode, the sputtering of materials from electrodes 26 and 30 will recoat the anode 16 itself further improving the quality of the surface of the anode 16 for production of x-rays. In the preferred embodiment, anode 16, electrodes 26 and 30 are silver and electrodes 28 and 32 are stainless steel and brass respectively.

By using a Penning trap 24 in the apparatus shown in FIG. 1, the rotating anode can be continuously cleaned by sputtering using ionized residuals and recoated by atoms emitted from the trap itself. Sputtering ions are provided solely by the residual gas atoms always found within an apparatus of this nature no matter how high the vacuum. The high vacuum in the interior region of housing 12 can be continuously maintained, allowing the anode to be cleaned while in operation.

The embodiments of the invention in which an exclusive property or privilege is claimed are defined as follows:

1. An x-ray source apparatus comprising:

a housing defining an enclosure and having an x-ray emission window therein;

means for evacuating said enclosure;

a rotatable anode means within said enclosure having a rotatable surface thereon;

a source of electrons;

means for attracting and causing movement of electrons from said source such that said electrons energetically impinge upon the rotatable surface in one region of the enclosure to produce x-rays;

means for producing ions capable of producing ions from residual particles in said enclosure, said means for producing ions located within said enclosure;

means for accelerating ions capable of accelerating ions produced by said means for producing ions such that said ions energetically impinge upon said rotatable surface in a second region of the enclosure to sputter impurities from the surface of said anode means said means for accelerating ions located within said enclosure.

2. The apparatus of claim 1 where said means for producing ions comprises a Penning trap.

3. The apparatus of claim 1 where said means for producing ions comprises;

a first tubular electrode having a central axis;

a second tubular electrode having a central axis and displaced from said first electrode and coaxial to said first electrode;

a third disk-shaped electrode having a central axis and being displaced from said first and said second electrodes and coaxial to said first and second electrodes;

a fourth electrode having a central axis and being displaced from said first, second and third electrodes and being coaxial with said first, second and third electrodes;

a toroidal magnet coaxial with said electrodes and enclosing a volume that contains only said second electrode;

means for maintaining said second and fourth electrodes at a positive electrical potential with respect to said first and third electrodes.

4. The apparatus of claim 3 where said second electrode and said fourth electrode are of the same material as said anode means.

5. The apparatus of claim 1 in which said means for producing ions produces ions from residual particles solely from within said enclosure.

6. The apparatus of claim 1 in which said housing defining an enclosure comprises:

a first evacuable chamber in which said rotatable anode means is located, and a second evacuable chamber in which said means for producing ions and said means for accelerating ions are located, said first evacuable chamber connected to said second evacuable chamber to allow ions produced by said means for producing ions and accelerated by said means for accelerating ions to pass from said second chamber to said first chamber.

* * * * *